US008677692B2

(12) United States Patent
Thiele et al.

(10) Patent No.: US 8,677,692 B2
(45) Date of Patent: Mar. 25, 2014

(54) DOOR LATCH COVER

(75) Inventors: Steven R. Thiele, Marysville, OH (US); Aaron R. Kerestan, Delaware, OH (US); Andrew Philip Dean, Northville, MI (US)

(73) Assignee: Honda Motor Co., Ltd., Tokyo (JP)

( * ) Notice: Subject to any disclaimer, the term of this patent is extended or adjusted under 35 U.S.C. 154(b) by 294 days.

(21) Appl. No.: 13/012,882

(22) Filed: Jan. 25, 2011

(65) Prior Publication Data

US 2012/0186159 A1 Jul. 26, 2012

(51) Int. Cl.
*E05B 1/00* (2006.01)
*E06B 3/30* (2006.01)

(52) U.S. Cl.
USPC ..... 49/460; 49/476.1; 49/360

(58) Field of Classification Search
USPC ..... 49/502, 449, 460, 462, 476.1, 360; 292/337
See application file for complete search history.

(56) References Cited

U.S. PATENT DOCUMENTS

| | | | | | |
|---|---|---|---|---|---|
| 3,580,017 | A | * | 5/1971 | Waldo | 70/81 |
| 4,735,447 | A | | 4/1988 | Kleefeldt | |
| 4,801,035 | A | * | 1/1989 | Sugiyama et al. | 220/3.8 |
| 4,913,477 | A | | 4/1990 | Watanuki et al. | |
| 5,028,084 | A | | 7/1991 | Fukumoto et al. | |
| 5,186,504 | A | | 2/1993 | Takaishi et al. | |
| 5,372,022 | A | * | 12/1994 | Terada et al. | 70/71 |
| 5,709,420 | A | | 1/1998 | Umino | |
| 5,855,400 | A | | 1/1999 | Ohhashi et al. | |
| D411,677 | S | * | 6/1999 | Kennamer | D34/10 |
| 6,062,254 | A | * | 5/2000 | Brady et al. | 137/382 |
| 6,086,131 | A | * | 7/2000 | Bingle et al. | 296/76 |
| 6,198,046 | B1 | * | 3/2001 | Moodie | 174/67 |
| 6,354,461 | B1 | * | 3/2002 | Tenney et al. | 220/836 |
| 6,357,266 | B1 | * | 3/2002 | Van Buren | 70/56 |
| 6,471,266 | B1 | * | 10/2002 | Yi | 292/346 |
| 6,554,329 | B1 | | 4/2003 | DeBlock et al. | |
| 7,003,915 | B2 | | 2/2006 | Yokomori | |
| D526,557 | S | * | 8/2006 | Falconer et al. | D8/346 |
| 7,320,495 | B2 | | 1/2008 | Menke | |
| D568,143 | S | * | 5/2008 | Sclater | D8/331 |
| D579,314 | S | * | 10/2008 | Tozer et al. | D8/331 |
| D584,595 | S | * | 1/2009 | Gray | D8/331 |
| 7,621,571 | B2 | | 11/2009 | Umino | |
| 7,637,542 | B2 | | 12/2009 | Suzumura et al. | |
| D618,136 | S | * | 6/2010 | Ward | D11/200 |
| 7,837,053 | B2 | * | 11/2010 | Arnett et al. | 220/326 |
| D630,970 | S | * | 1/2011 | McNaughton | D11/200 |
| D642,043 | S | * | 7/2011 | Le | D8/331 |
| 2007/0147602 | A1 | * | 6/2007 | Vo | 379/413.02 |

OTHER PUBLICATIONS

Photograph of 2008 PT Cruiser Convertible Door.

* cited by examiner

*Primary Examiner* — Katherine Mitchell
*Assistant Examiner* — Shiref Mekhaeil
(74) *Attorney, Agent, or Firm* — Fay Sharpe LLP

(57) ABSTRACT

A cover for an automatic vehicle door latch. The cover comprises a first wall having a free top and bottom edge, and a second edge intersecting an edge of a second wall. The second wall also includes top, free and bottom edges, wherein the bottom and top edge of the first and second walls are contiguous. The first and second walls are angled relative to one another at the intersecting edges. A top ridge protrudes from the walls adjacent the top edges, and a second ridge protrudes from the wall between the top and bottom ridges such that the top ridge and the second ridge define a channel therebetween.

12 Claims, 4 Drawing Sheets

FIG. 1
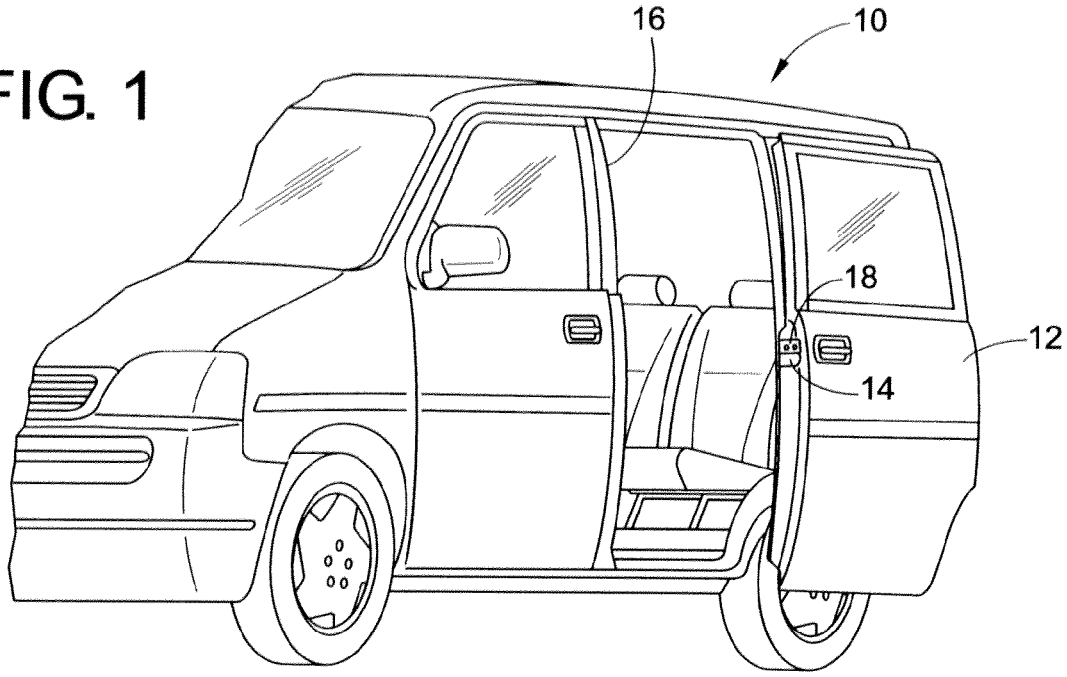
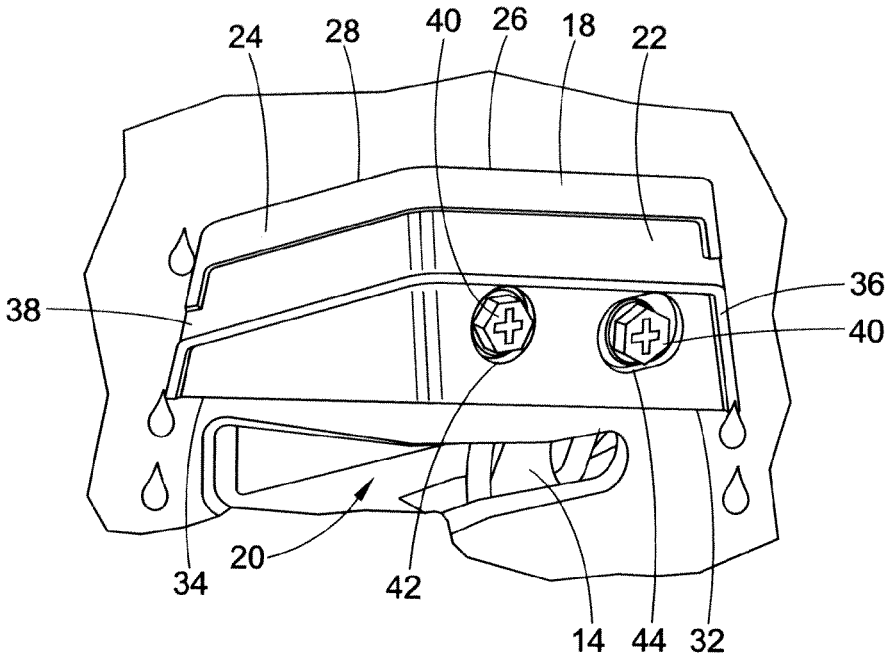
FIG. 2

DOOR LATCH COVER

BACKGROUND

The present exemplary embodiment relates to a cover for a door latch. It finds particular application in conjunction with a sliding automotive vehicle door, and will be described with particular reference thereto. However, it is to be appreciated that the present exemplary embodiment is also amenable to other similar applications.

A door lock for an automotive vehicle is assembled in an automotive vehicle door to lock/unlock the vehicle door. Usually, the door lock mechanism includes a latch and striker assembly. Typically, a control mechanism for controllably actuating the latch locking/unlocking pawl is pivotally mounted on the surface of a base plate. This control mechanism is composed of a plurality of externally extending levers (i.e. an outside handle lever, an inside handle lever, a lock handle lever, etc.) with other lock/unlock levers interconnecting these handle levers, which are all pivotally supported by many support pins fixed to the base plate.

Since water can flow into the door lock along the inside surface of the door or door window glass, there exists a problem that the mechanical elements arranged within the door lock can become rusted by water and therefore will not operate reliably. In addition, in winter or in cold districts, since water flowing into the door lock can become frozen, there exists the problem that the door lock cannot be actuated and therefore door operation is disabled.

To overcome the above-mentioned problem, it can be desirable to cover the locking mechanism with a water deflecting cover.

BRIEF DESCRIPTION

Various details of the present disclosure are hereinafter summarized to provide a basic understanding. This summary is not an extensive overview of the disclosure, and is intended neither to identify certain elements of the disclosure, nor to delineate the scope thereof. Rather, the primary purpose of this summary is to present some concepts of the disclosure in a simplified form prior to the more detailed description that is presented hereinafter.

According to one embodiment, a cover for an automotive vehicle door latch is disclosed. The cover has a first wall having top and bottom edges, and further including a second edge intersecting an edge of a second wall. The second wall also includes top and bottom edges, the top and bottom edges of the first and second walls being contiguous. The first and second walls are angled at the intersecting edge. A top ridge protrudes from the walls adjacent the top edges. A second ridge protrudes from the walls between the top and bottom edges. The top ridge and the second ridge define a channel therebetween.

According to a second embodiment, a sliding door of an automotive vehicle including a latch adapted to receive a striker is provided. A cover having a first wall including top, bottom, and free edges, and a second edge intersecting an edge of a second wall overlays the door latch. The second wall includes top, bottom and free edges. The top edge of the first and second walls are contiguous. The first and second walls are angled at the intersecting edges. A ridge protrudes from the walls and extends across the walls from free edge to free edge.

According to a further embodiment, a cover comprised of a plastic body is disclosed. The body includes a first wall and an intersecting second wall angled relative to the first wall.

The first and second walls have contiguous top and bottom edges. A contiguous ridge protrudes from the first and second walls and includes terminal portion extending downwardly adjacent a free edge of the first and second walls and intersecting the bottom edges. The ridge is inclined toward the bottom edge on the second wall in the direction of the free edge.

BRIEF DESCRIPTION OF THE DRAWINGS

The following description and drawings set forth certain illustrative implementations of the disclosure in detail, which are indicative of several exemplary ways in which the various principles of the disclosure may be carried out. The illustrated examples, however, are not exhaustive of the many possible embodiments of the disclosure. Other objects, advantages and novel features of the disclosure will be set forth in the following detailed description of the disclosure when considered in conjunction with the drawings, in which:

FIG. 1 is a perspective view of an automotive vehicle schematically illustrating a door lock apparatus according to the present embodiment;

FIG. 2 is a perspective view of a latch component of the automotive vehicle door of FIG. 1;

DETAILED DESCRIPTION

Figure 3:
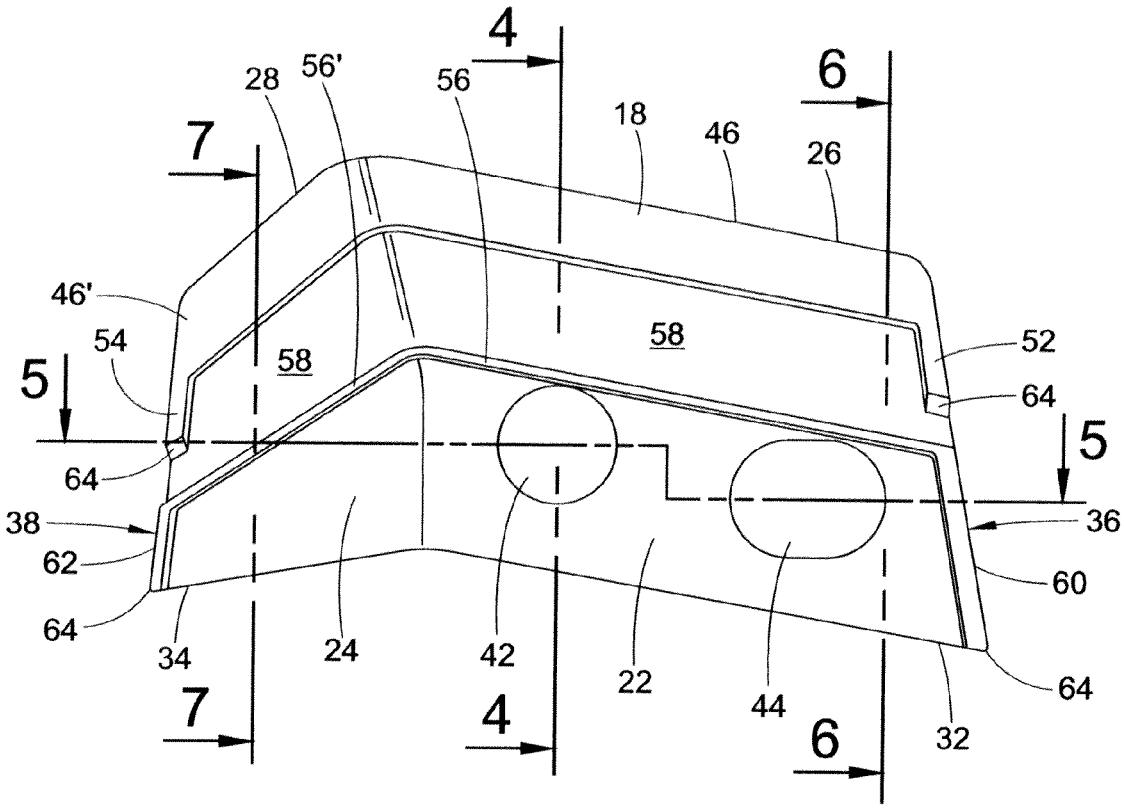
FIG. 3 is a side elevation view of the door latch cover of FIG. 2.
Figure 4:
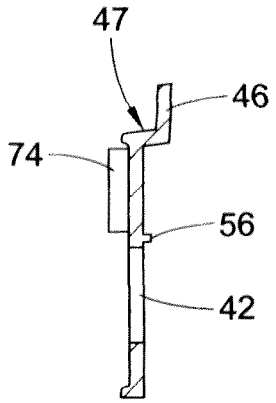
FIG. 4 is a cross-section view taken along line 4-4.

An embodiment of the present invention will be explained with reference to the figures. FIG. 1 is a schematic diagram illustrating vehicle 10 including a sliding door 12 having a latch assembly 14 consisting of a recessed latch which mates with a striker (not shown) mounted on pillar 16. A protective cover 18 overlays latch assembly 14 to reduce water ingress therein. Of course, it is noted that the type of the vehicle door is not limited. For example, the vehicle door can be a hinge type door or a sliding door.

Referring now to FIG. 2, cover 18 is shown in its installed position overlaying latch assembly 14 disposed within recess 20. Cover 18 includes a first wall 22 and a second wall 24. Walls 22 and 24 have contiguous top edges 26 and 28, respectively, contiguous bottom edges 32 and 34, respectively, and each includes an outwardly and downwardly sloping free edge 36 and 38, respectively. Cover 18 is secured to the door 12 via bolts 40 passing through passages 42 and 44. The cover can be comprised of any plastic material such as polycarbonate, polyethylene, polypropylene, etc.

Referring now to FIGS. 3-8, cover 18 is shown in detail. A first ridge 46 and 46' is formed on walls 22 and 24 adjacent top edges 26 and 28. Ridges 46 and 46' effectively form a trough 47 (see FIGS. 4 and 6-9) with the door surface to direct water away from the latch assembly. In this manner, water flowing down the door wall is first directed away from recess 20 by trough 47 formed by ridges 46 and 46'. Furthermore, top edge 28 and ridge 46' angle downwardly towards bottom edge 34 to encourage water flow in that direction. Ribs 52 and 54 depend from the top ridges 46 and 46' adjacent each of the free ends 36 and 38 of the walls 22 and 24. Ribs 52 and 54 help prevent water from flowing back onto the surface of cover 18.

A second ridge 56 and 56' protrudes from walls 22 and 24, respectively, and extends between the free ends 36 and 38 forming a channel 58 between first ridge 46/46' and second ridge 56/56'. Second ridge 56/56' includes depending fingers 60 and 62 adjacent free edges 36 and 38 of the first wall 22 and second wall 24. Water that overflows ridges 46 and 46' is diverted by channel 58 to the periphery of the cover 18 and wicked along the outside of edges 36 and 38 by finger ribs 60 and 62 remote from the latch assembly 14.

To further facilitate flow of water away from the latch assembly 14, ridge 56' is inclined downwardly toward bottom edge 34. Advantageously, the ribs 52 and 54 and depending fingers 60 and 62 have a terminal portion having obtuse orientation 64 which prevents water from wicking back onto the cover 18.

Passages 42 and 44 are provided to allow insertion of bolts (40) or screws for mating with the door 12. Passage 42 is circular to allow installation of the latch datum bolt. Passage 44 is oval to facilitate installation of a second bolt with allowance for bolt position variation.

Figure 5:
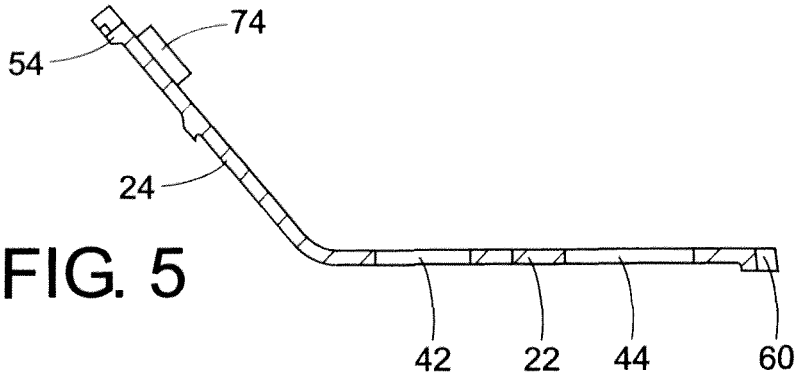
FIG. 5 is a cross-section view taken along line 5-5.
Figure 6:
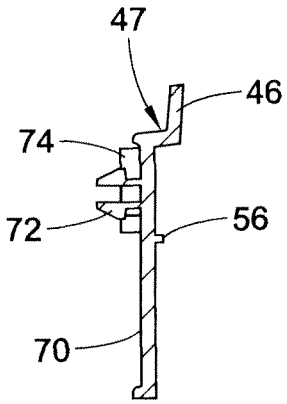
FIG. 6 is a cross-section view taken along line 6-6.
Figure 7:
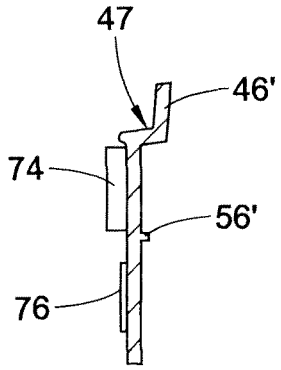
FIG. 7 is a cross-section view taken along line 7-7.
Figure 8:
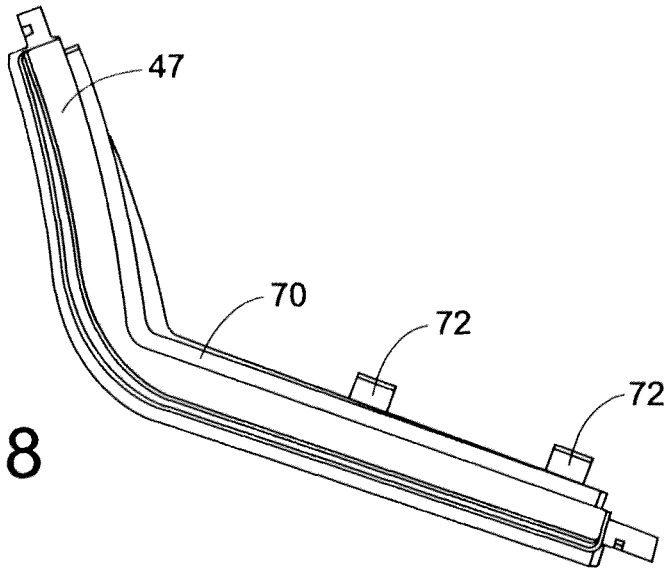
FIG. 8 is a top view of the cover.
Figure 9:
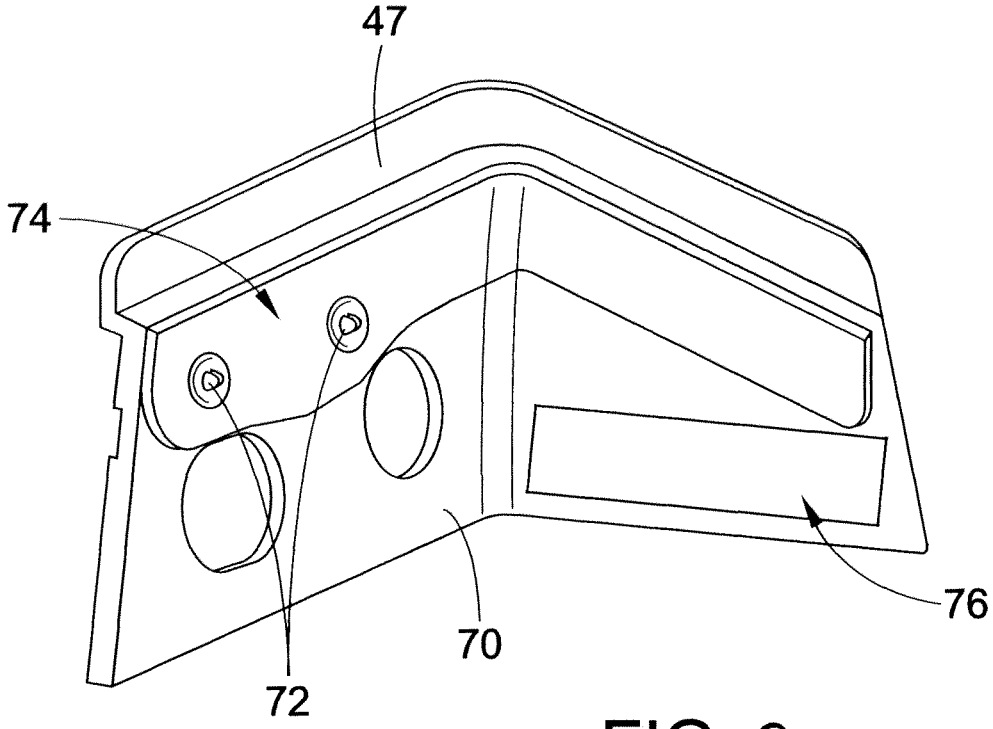
FIG. 9 is a rear perspective view of the cover.

As seen in FIG. 5, first wall 22 and second wall 24 are angled relative to one another. As depicted, the angle is approximately 130 degrees; however, any angle suited for mating of the cover to the door frame is acceptable. Also provided on a inner surface 70 are clips 72 which are received in passages (not shown) in the door 12. An additional sealing member 74 (see FIGS. 6, 7 and 9) is provided along the inner surface 70 adjacent top edges 26 and 28. The sealing member can be comprised of any suitable material, such as an EPDM foam. A two-sided tape 76 is provided to further secure inner surface 70 of wall 24 to the door 12.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A cover for an automotive vehicle door latch, said cover comprising a first wall having a top and a bottom edge, a first end of the first wall mating with an end of a second wall, the second wall including top and bottom edges, the bottom and top edges of said first and second walls being contiguous, said first and second walls being angled at the mating ends, the first and second walls forming a contiguous inner surface and a contiguous outer surface, a top ridge protruding from said outer surface in a direction away from said inner surface and located adjacent the top edges, a first pair of ribs depending from terminal ends of the top ridge adjacent side edges of the first and second walls, a bottom ridge protruding from said outer surface in a direction opposite said inner surface and located between said top and bottom edges, a second pair of ribs depending from terminal ends of the bottom ridge adjacent side edges of the first and second walls, said ribs depending from the top ridge not intersecting said second ridge such that the top ridge and the second ridge define a channel on the outer surface between the top and bottom edges for directing water away from the door latch.

2. The cover of claim 1 wherein each of said second pair of ribs intersect the bottom edge of the first and second walls.

3. The cover of claim 2 wherein each of said second pair of ribs are oriented at an acute angle relative to said bottom edge of a respective one of the first and second wall.

4. The cover of claim 2 wherein each of said second pair of ribs terminate at the bottom edge at an acute angle.

5. The cover of claim 1 wherein said inner surface includes at least one clip element adapted to be received in a vehicle door.

6. The cover of claim 1 further comprising a seal element and a double sided tape secured to said inner surface.

7. The cover of claim 1 including at least one through hole suitable for accommodating a bolt or screw.

8. The cover of claim 7 wherein said at least one through hole comprises two through holes in the first wall, a first hole being substantially circular and a second hole being substantially oval.

9. The cover of claim 1 wherein a length of a terminal end of the first wall is greater than a length of a terminal end of the second wall.

10. The cover of claim 1 wherein the angle between the first and second walls is greater than 90 degrees.

11. The cover of claim 1 wherein said top ridge extends substantially perpendicular to said outer surface.

12. The cover of claim 1 wherein said bottom ridge and said second pair of ribs extend perpendicular to said outer surface.

* * * * *